US005123384A

United States Patent [19]

Abbas

[11] Patent Number: 5,123,384

[45] Date of Patent: Jun. 23, 1992

[54] PEDESTAL-MOUNTED ROCKER ARM WITH BUSHING

[75] Inventor: Sherkoh A. Abbas, Maumee, Ohio

[73] Assignee: Henley Manufacturing Holding Company, Inc., Hampton, N.H.

[21] Appl. No.: 780,043

[22] Filed: Oct. 21, 1991

[51] Int. Cl.[5] ..... F01L 1/18

[52] U.S. Cl. ..... 123/90.39; 123/90.41; 74/519; 74/559

[58] Field of Search ..... 123/90.39, 90.41, 90.42, 123/90.47; 74/519, 559

[56] References Cited

U.S. PATENT DOCUMENTS

| | | | |
|---|---|---|---|
| 2,905,161 | 9/1959 | Latham | 123/90.39 |
| 3,150,648 | 9/1964 | Gropp | 123/90.39 |
| 4,829,647 | 5/1989 | Anderson et al. | 123/90.39 |
| 4,848,180 | 7/1989 | Mills | 74/519 |
| 4,944,257 | 7/1990 | Mills | 123/90.39 |
| 5,010,857 | 4/1991 | Hempelmann et al. | 123/90.39 |
| 5,060,606 | 10/1991 | Hubbard | 123/90.39 |
| 5,063,889 | 11/1991 | Pryba et al. | 123/90.39 |
| 5,074,261 | 12/1991 | Hamburg et al. | 123/90.39 |

*Primary Examiner*—Tony M. Argenbright
*Assistant Examiner*—Weilun Lo
*Attorney, Agent, or Firm*—Allen D. Gutchess, Jr.

[57] ABSTRACT

A rocker arm has a cold-formed, one-piece metal body of generally U-shaped cross section throughout most of its length. The body has a bottom wall and two generally parallel side walls which extend upwardly therefrom and are structurally integral therewith. The rocker arm body has a recess at one end to engage an end of a push rod and a surface at the other end to engage an end of a valve stem. The side walls of the body have aligned circular openings therein through which a cylindrial bushing extends and is affixed to the side walls by brazing or the like. For a pedestal mount, the bushing has an elongate opening facing downwardly to receive a pedestal and has a large upper opening for clearance around a portion of the pedestal. Small oil reservoirs are formed between the bottom wall of the rocker arm body and edge portions of the bushing adjacent the large upper opening.

18 Claims, 2 Drawing Sheets

PEDESTAL-MOUNTED ROCKER ARM WITH BUSHING

This invention relates to a cold-formed rocker arm having a bushing extending through side walls thereof to receive bearings.

A rocker arm in accordance with the invention has a cold-formed, one-piece metal body of generally U-shaped cross section throughout most of its length. The body has a bottom wall and two generally parallel side walls which extend upwardly therefrom and are structurally integral therewith. The rocker arm body has means in the form of a recess at one end to engage an end of a push rod and a curved surface at the other end in the form of a roller or pad to engage an end of a valve stem.

A rocker arm of this general type is shown in U.S. Pat. No. 4,944,257, which issued July 31, 1990. In that rocker arm, the side walls of the rocker arm body had annular flanges or hubs extending outwardly therefrom, being stamped or extruded in the side walls. The flanges formed aligned bores which received bearings.

In the rocker arm in accordance with the invention, the side walls of the rocker arm body have aligned circular openings therein through which a bushing extends and is affixed to the side walls, preferably by brazing. While the new rocker arm requires an additional part, the rocker arm is easier to manufacture, particularly since the bushing does not tend to deform when the rocker arm is heat-treated. The rocker arm with the bushing also tends to reduce any cracks occurring in the saddle or central portion of the bottom wall. In addition, the rocker arm with the separate bushing is substantially stronger, with the new rocker arm enduring a pressure before failure which is over fifty percent higher than that of the aforementioned rocker arm. The new rocker arm also has a reduced moment of inertia, with the center of gravity being nearer the pivot axis of the arm. Bearing friction also tends to be reduced.

With the rocker arm in accordance with the invention being pedestal mounted, the bottom wall of the rocker arm in the central or saddle area has an elongate opening through which a central post of the pedestal extends. The bushing also has a similar elongate opening facing downwardly and aligned with the rocker arm opening to receive the post. In addition, an upper portion of the bushing has a large rectangular opening to receive and clear an upper portion of the pedestal. End portions of the bushing carry bearings which rotatably support the rocker arm on cylindrical extensions of a hub of the pedestal.

In a preferred form, side edges of the bushing forming the upper opening extend slightly above the inner surface of the bottom wall of the rocker arm to form small oil reservoirs which can supply oil substantially immediately to the bearing area when the engine is started.

In one form of the invention, a lubrication port is formed in the bottom wall of the rocker arm between the bushing and the curved surface which engages the end of the valve stem to supply oil to that surface more readily.

It is, therefore, a principal object of the invention to provide a cold-formed rocker arm with a separate bushing extending through side walls thereof and affixed thereto, having the improvements and advantages discussed above.

Another object of the invention is to provide a cold-formed, pedestal-mounted rocker arm having a downwardly-facing opening to receive a pedestal post and a larger upper opening to receive an upper portion of the pedestal, with bearings carried in each end portion of the bushing.

Yet another object of the invention is to provide a pedestal-mounted rocker arm having a surface at one end to engage a valve stem and having an oil port extending through a bottom wall of the rocker arm body between a central portion thereof and the surface.

Many other objects and advantages of the invention will be apparent from the following detailed description of a preferred embodiment thereof, reference being made to the accompanying drawings, in which.

Figure 1:
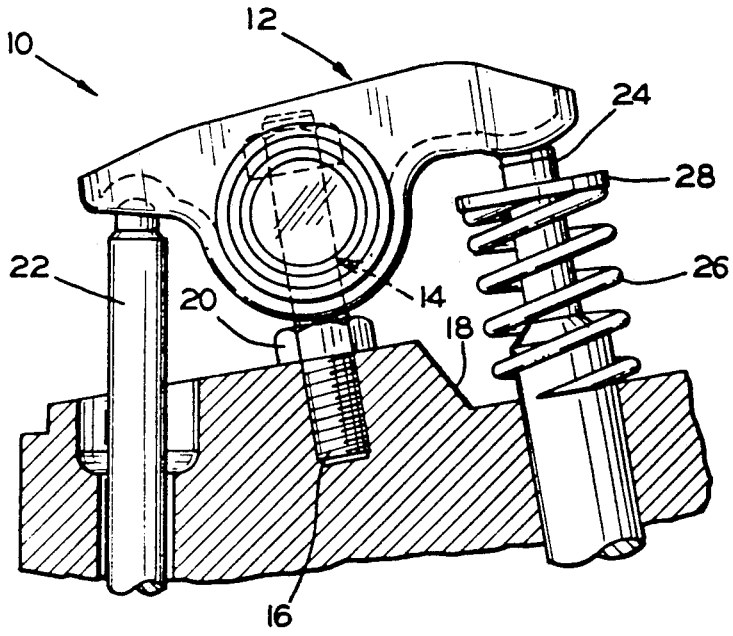
FIG. 1 is a somewhat schematic side view in elevation of a rocker arm assembly in accordance with the invention, mounted on an engine which is shown in cross section.

Referring particularly to FIG. 1, a rocker arm assembly in accordance with the invention is indicated at 10 and includes an elongate, cold-formed rocker arm 12 which is rotatably mounted on a supporting pedestal indicated at 14. A suitable threaded post or shank 16 extends through a bore in the pedestal and mounts the rocker arm assembly on a cylinder head 18 of an engine block, with a nut 20 being on the post 16 and in engagement with the engine block. One end of the rocker arm 12 engages the upper end of a push rod 22 and the other end of the rocker arm engages the upper end of the valve stem 24. The valve stem extends upwardly from a valve (not shown) in the cylinder head and through a compression spring 26 which is between the cylinder head and a retaining ring 28 mounted on the valve stem.

Figure 2:
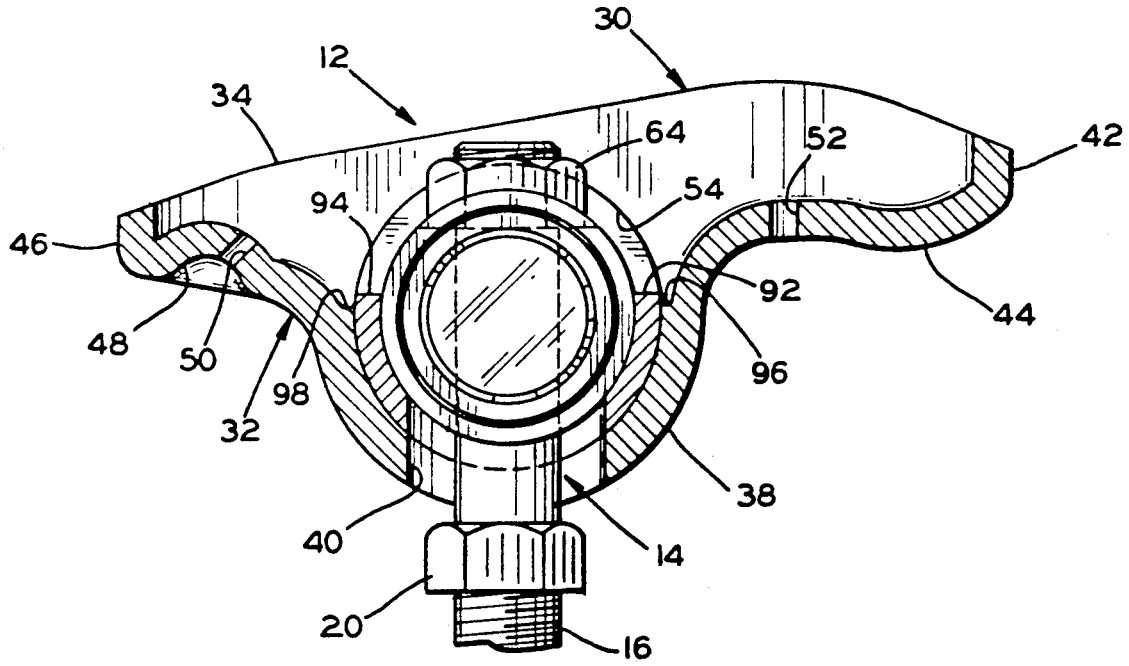
FIG. 2 is an enlarged view in longitudinal cross section of the rocker arm assembly shown in FIG. 1.
Figure 3:
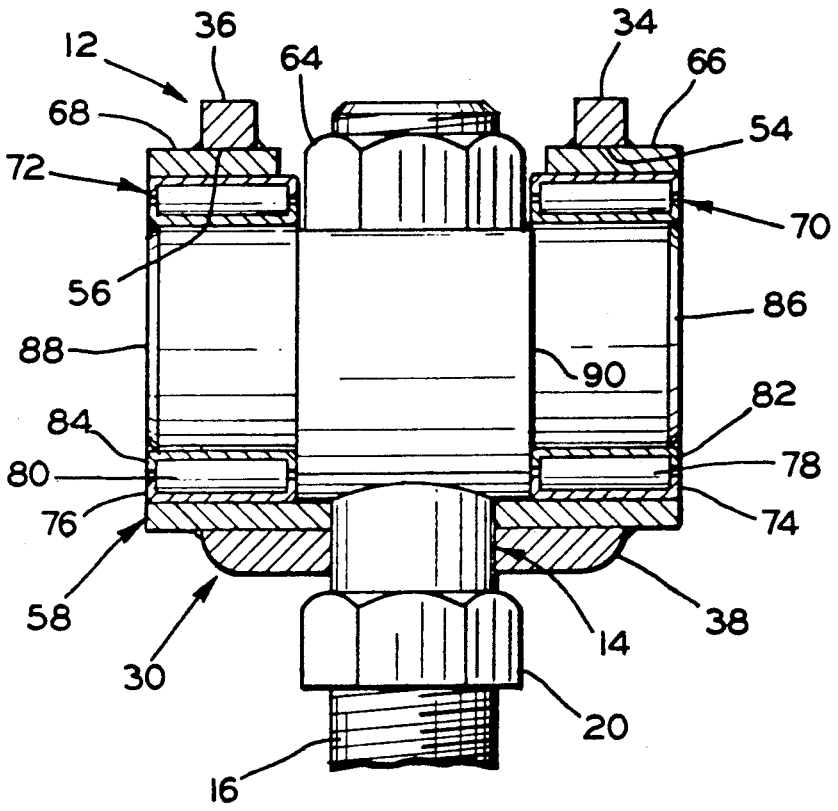
FIG. 3 is a view in transverse cross section taken centrally through the rocker arm assembly of FIG. 2.
Figure 4:
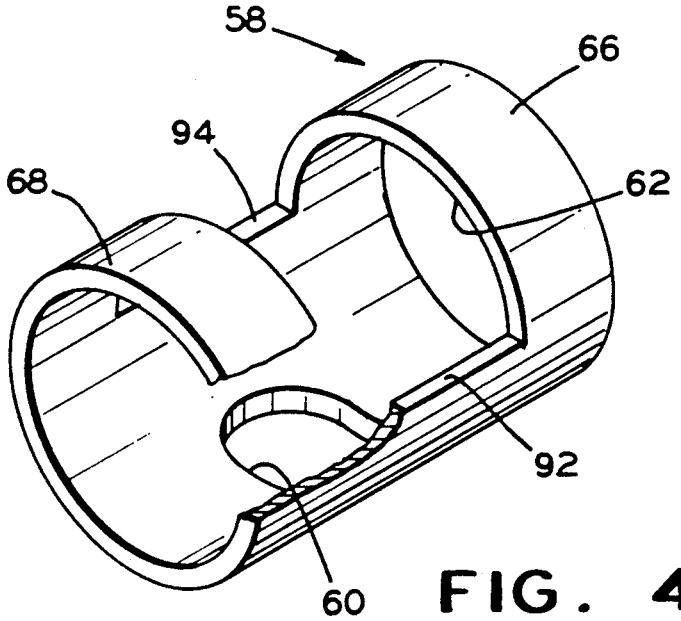
FIG. 4 is a perspective view, with a portion broken away, of a bushing employed in the rocker arm body.

Referring to FIGS. 2 and 3, the rocker arm 12 includes a one-piece, cold-formed metal body 30 having a bottom connecting wall 32 and two structurally-integral side walls 34 and 36 extending upwardly therefrom and being in generally parallel relationship throughout most of their length. The body is of generally U-shaped configuration in transverse cross section throughout most of its length. A central or saddle portion 38 of the bottom wall 32 is rounded and has an oblong hole 40 therein to receive the post 16 of the pedestal 14.

One end portion 42 of the rocker arm body 30 has means to engage the upper end of the valve stem 24. In this instance, the means is in the form of a pad 44, but could also be a roller. In either event, a curved downwardly-facing surface is formed to contact the valve stem. Another end portion 46 of the rocker arm body has means to engage the upper end of the push rod 22. This is shown in the form of a generally semi-spherical, downwardly-facing recess 48 which fits over the rounded upper end of the push rod. An oil port 50 is formed in the bottom wall 32 and communicates with the recess 48 to receive oil from a passage (not shown) in the push rod 22. An oil port 52 is also formed through the bottom wall between the central portion 38 and the one end portion 42. This enables oil to be supplied more readily to the surface 44 engaging the valve stem 24.

Central portions of the side walls 34 and 36 have aligned circular openings 54 and 56 formed therein. A central bushing 58 has a length exceeding the distance between the side walls 34 and 36, extending through both openings and being affixed to the side walls. This preferably is accomplished by brazing. The brazing metal extends around the bushing 58 at the side wall openings 54 and 56 and also extends between the lower central portion of the bushing 58 and the inner surface of the central portion 38 of the bottom wall 32. The bushing 58 has an elongate opening 60 facing downwardly to also receive the post or shank 16. The opening 60 can be of substantially the same size and shape as the opening 40 in the central portion 38 of the bottom wall 32 and is aligned therewith. The bushing 58 further has a large upper opening 62 of generally rectangular shape to clear the upper end of the shank 16 and an upper nut 64 which is threaded thereon.

Continuous cylindrical band portions 66 and 68 are formed at end portions of the bushing 58 beyond the ends of the large opening 62 for bearings 70 and 72. Outer bearing races 74 and 76 are press fit in the band portions 66 and 68 of the bushing and retain rolling elements or needles 78 and 80. Inner races 82 and 84 of the bearings 70 and 72 are mounted on cylindrical extensions 86 and 88 which extend outwardly from a hub 90 through which the post 16 extends. The bushing 58 is bored before assembly with the bearings 70 and 72.

In a preferred form, side edges 92 and 94 of the bushing 58, on each side of the large opening 62, extend upwardly and inwardly to some extent from the inner surface of the central bottom wall portion 38, as shown in FIG. 2. With this arrangement, small oil reservoirs 96 and 98 are formed so as to quickly supply oil to the bearings when the engine is started.

The rocker arm 12 with the bushing 58 has a number of advantages. The bushing 58 does not tend to distort or deform when the assembled rocker arm is annealed. The bushing 58 also tends to reinforce the central bottom wall portion 38 of the bottom wall 32 to substantially reduce stress cracks therein. The rocker arm 12 also tends to be much stronger and withstands greater forces before cracking or fracturing. Since the bushing 58 is affixed to both the side walls 34 and 36 of the rocker arm body, a buckling effect or in-and-out movement of the side walls during operation of the rocker arm is reduced. Because the inner surface of the bushing 58 is more precise, less bearing friction occurs in the central or saddle area of the rocker arm. With this design, reduced moment of inertia results because the center of gravity is nearer the pivotal axis of the rocker arm.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A rocker arm comprising a cold-formed, one-piece metal body of generally U-shaped cross section throughout most of its length, said body having a bottom wall and two generally parallel side walls extending upwardly therefrom and structurally integral therewith, said body having means at one end to engage an end of a push rod and means at the other end to engage an end of a valve stem, said side walls of said body having aligned circular openings therethrough, a cylindrical bushing extending through said openings and affixed to said side walls, said bushing having an elongate opening facing downwardly and a larger upper opening.

2. A rocker arm according to claim 1 wherein small oil reservoirs are formed between said bottom wall and edge portions of said bushing adjacent said larger upper opening.

3. A rocker arm according to claim 1 wherein a pedestal extends through said elongate opening and said large upper opening in said bushing.

4. A rocker arm according to claim 3 wherein said pedestal has a hub with cylindrical extensions extending outwardly from both sides thereof, and bearings are located between said extensions and end portions of said bushing beyond said elongate opening and said large upper opening of said bushing.

5. A rocker arm according to claim 4 wherein said bearings include outer races held by said end portions of said bushings and inner races mounted on said hub extensions, and roller elements located between said inner and outer races.

6. A rocker arm according to claim 1 wherein said bushing is affixed to said side walls and to a central portion of the inner surface of said bottom wall by brazing metal.

7. A rocker arm comprising a cold-formed, one-piece metal body having two generally parallel side walls and a connecting wall structurally integral therewith, said body having means at one end to engage an end of a push rod and means at the other end to engage an end of a valve stem, said side walls of said body having aligned circular openings therethrough, a cylindrical bushing extending through said openings and affixed to said side walls, said bushing having lower and upper openings to receive a pedestal for mounting said rocker arm on an engine.

8. A rocker arm according to claim 7 wherein small oil reservoirs are formed between said connecting wall and edge portions of said bushing adjacent said upper opening.

9. A rocker arm according to claim 7 wherein said bushing is affixed to said side walls and to a portion of an inner surface of said connecting wall by brazing metal.

10. A rocker arm according to claim 7 wherein a pedestal extends through said lower and upper openings of said bushing.

11. A rocker arm according to claim 10 wherein said pedestal has a hub with cylindrical extensions extending outwardly from both sides thereof, and bearings are located between said extensions and end portions of said bushing beyond said lower and upper openings of said bushing.

12. A rocker arm according to claim 11 wherein said bearings include outer races held by said end portions of said bushings and inner races mounted on said hub extensions, and roller elements located between said inner and outer races.

13. A rocker arm assembly comprising a rocker arm body having two side walls and a connecting wall structurally integral therewith, said body having means at one end to engage an end of a push rod and means at the other end to engage the end of a valve stem, said side walls of said body having aligned circular openings therethrough, a bushing extending through said openings and affixed to said side walls, said bushing having a lower opening facing downwardly and an upper opening, said bushing forming cylindrical bands on both sides of said lower and upper openings, a pedestal post extending through said bushing openings, a hub on said pedestal post, said hub having cylindrical extensions extending outwardly from both sides thereof, and bearings between said extensions and said cylindrical bands of said bushing.

14. A rocker arm assembly according to claim 13 wherein said bearings includes outer races held by said cylindrical bands and inner races mounted on said hub extensions, and roller elements located between said inner and outer races.

15. A rocker arm assembly according to claim 13 wherein said connecting wall is a bottom wall connecting lower edges of said side walls, said bottom wall having an opening through which said pedestal post extends.

16. A rocker arm assembly according to claim 13 wherein brazing metal affixes said bushing to said side walls of said rocker arm.

17. A rocker arm assembly according to claim 16 wherein brazing metal also affixes said bushing to a portion of an inner surface of said connecting wall.

18. A rocker arm assembly according to claim 13 wherein small oil reservoirs are formed between said connecting wall and edge portions of said bushing adjacent said upper opening.

* * * * *